US008102342B2

(12) United States Patent
Shigeta et al.

(10) Patent No.: US 8,102,342 B2
(45) Date of Patent: Jan. 24, 2012

(54) DISPLAY APPARATUS INCLUDING A DRIVER USING A LOOKUP TABLE

(75) Inventors: Hiroaki Shigeta, Tenri (JP); Taketoshi Nakano, Palatine, IL (US)

(73) Assignee: Sharp Kabushiki Kaisha, Osaka (JP)

( * ) Notice: Subject to any disclaimer, the term of this patent is extended or adjusted under 35 U.S.C. 154(b) by 815 days.

(21) Appl. No.: 11/883,714

(22) PCT Filed: Mar. 6, 2006

(86) PCT No.: PCT/JP2006/004250

§ 371 (c)(1),
(2), (4) Date: Aug. 3, 2007

(87) PCT Pub. No.: WO2006/126322

PCT Pub. Date: Nov. 30, 2006

(65) Prior Publication Data

US 2009/0121990 A1 May 14, 2009

(30) Foreign Application Priority Data

May 25, 2005 (JP) ..... 2005-152804

(51) Int. Cl.
*G09G 3/36* (2006.01)

(52) U.S. Cl. ..... 345/89; 345/690

(58) Field of Classification Search ..... 345/87, 345/88, 102, 89, 690
See application file for complete search history.

(56) References Cited

U.S. PATENT DOCUMENTS

| | | | | |
|---|---|---|---|---|
| 6,501,470 | B1 * | 12/2002 | Miura | 345/421 |
| 6,791,525 | B2 * | 9/2004 | Matsumura et al. | 345/100 |
| 2003/0038768 | A1 * | 2/2003 | Sakashita | 345/87 |
| 2003/0179175 | A1 | 9/2003 | Shigeta et al. | |
| 2004/0263467 | A1 * | 12/2004 | Kitagawa et al. | 345/102 |

FOREIGN PATENT DOCUMENTS

| | | |
|---|---|---|
| JP | 7-56532 | 3/1995 |
| JP | 11-126050 | 5/1999 |
| JP | 2004-109796 | 4/2004 |
| JP | 2004-348162 | 12/2004 |

* cited by examiner

*Primary Examiner* — Chanh Nguyen
*Assistant Examiner* — Ram Mistry
(74) *Attorney, Agent, or Firm* — Harness, Dickey & Pierce, PLC

(57) ABSTRACT

A threshold table (3) has stored therein thresholds for classifying gradation values, and the gradation values are classified into a plurality of gradation sections in accordance with the thresholds. A look-up table (2) has stored therein differential gradation values corresponding to combinations of gradation section values for data concerning the current frame data and gradation section values for data concerning an immediately preceding frame. A frame memory (21) has stored therein gradation section values for pixels. A control circuit (22) refers to the look-up table (2) and the threshold table (3) to calculate a differential gradation value based on a gradation value indicated by image data (DAT) for the current frame and a gradation section value of previous frame data stored in the frame memory (21). A display data calculation circuit (23) calculates an applied gradation value for the current frame data based on the differential gradation value.

6 Claims, 11 Drawing Sheets

Fig.3

POSTERIOR GRADATION VALUE

PRIOR GRADATION VALUE

| | 0 | ··· | 32 | ··· | 64 | ··· | 96 | ··· | 128 | ··· | 160 | ··· | 192 | ··· | 224 | ··· | 255 |
|---|---|---|---|---|---|---|---|---|---|---|---|---|---|---|---|---|---|
| 0 | 0 | ··· | 80 | ··· | 108 | ··· | 102 | ··· | 85 | ··· | 65 | ··· | 43 | ··· | 22 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 32 | 0 | ··· | 0 | ··· | 40 | ··· | 49 | ··· | 48 | ··· | 41 | ··· | 29 | ··· | 16 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 64 | 0 | ··· | -18 | ··· | 0 | ··· | 20 | ··· | 27 | ··· | 29 | ··· | 22 | ··· | 14 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 96 | 0 | ··· | -23 | ··· | -21 | ··· | 0 | ··· | 13 | ··· | 19 | ··· | 17 | ··· | 12 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 128 | 0 | ··· | -26 | ··· | -37 | ··· | -18 | ··· | 0 | ··· | 10 | ··· | 12 | ··· | 10 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 160 | 0 | ··· | -28 | ··· | -44 | ··· | -36 | ··· | -14 | ··· | 0 | ··· | 6 | ··· | 7 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 192 | 0 | ··· | -30 | ··· | -50 | ··· | -52 | ··· | -28 | ··· | -10 | ··· | 0 | ··· | 4 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 224 | 0 | ··· | -32 | ··· | -54 | ··· | -68 | ··· | -49 | ··· | -23 | ··· | -8 | ··· | 0 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 255 | 0 | ··· | -32 | ··· | -58 | ··· | -78 | ··· | -72 | ··· | -44 | ··· | -22 | ··· | -5 | ··· | 0 |

Fig.4

POSTERIOR GRADATION VALUE

PRIOR GRADATION VALUE

| | 0 | ··· | 32 | ··· | 64 | ··· | 96 | ··· | 128 | ··· | 160 | ··· | 192 | ··· | 224 | ··· | 255 |
|---|---|---|---|---|---|---|---|---|---|---|---|---|---|---|---|---|---|
| 0 | 0 | ··· | 80 | ··· | 108 | ··· | 102 | ··· | 85 | ··· | 65 | ··· | 43 | ··· | 22 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 32 | 0 | ··· | 0 | ··· | 40 | ··· | 49 | ··· | 48 | ··· | 41 | ··· | 29 | ··· | 16 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 64 | 0 | ··· | -20 | ··· | 0 | ··· | 20 | ··· | 20 | ··· | 20 | ··· | 20 | ··· | 15 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 96 | 0 | ··· | -20 | ··· | -20 | ··· | 0 | ··· | 20 | ··· | 20 | ··· | 20 | ··· | 15 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 128 | 0 | ··· | -27 | ··· | -40 | ··· | -25 | ··· | 0 | ··· | 10 | ··· | 10 | ··· | 10 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 160 | 0 | ··· | -27 | ··· | -40 | ··· | -25 | ··· | -14 | ··· | 0 | ··· | 10 | ··· | 10 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 192 | 0 | ··· | -30 | ··· | -50 | ··· | -60 | ··· | -35 | ··· | -15 | ··· | 0 | ··· | 4 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 224 | 0 | ··· | -30 | ··· | -50 | ··· | -60 | ··· | -35 | ··· | -15 | ··· | -8 | ··· | 0 | ··· | 0 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 255 | 0 | ··· | -32 | ··· | -58 | ··· | -78 | ··· | -72 | ··· | -44 | ··· | -22 | ··· | -5 | ··· | 0 |

Fig.6

POSTERIOR GRADATION SECTION VALUE

PRIOR GRADATION SECTION VALUE

| | 0 | 1 | 2 | 3 | 4 | 5 | 6 | 7 |
|---|---|---|---|---|---|---|---|---|
| 0 | 0 | 40 | 80 | 105 | 75 | 33 | 16 | 0 |
| 1 | 0 | 0 | 40 | 75 | 60 | 27 | 13 | 0 |
| 2 | 0 | 0 | 0 | 45 | 45 | 22 | 11 | 0 |
| 3 | 0 | -10 | -20 | 0 | 20 | 15 | 10 | 0 |
| 4 | 0 | -15 | -25 | -50 | 0 | 10 | 5 | 0 |
| 5 | 0 | -20 | -30 | -55 | -25 | 0 | 2 | 0 |
| 6 | 0 | -20 | -30 | -60 | -40 | -6 | 0 | 0 |
| 7 | 0 | -20 | -30 | -65 | -58 | -13 | -6 | 0 |

Fig.7

| GRADATION SECTION VALUES | MAXIMUM GRADATION VALUES |
|---|---|
| 0 | 1 |
| 1 | 15 |
| 2 | 63 |
| 3 | 127 |
| 4 | 191 |
| 5 | 239 |
| 6 | 253 |
| 7 | 255 |

Fig.8A

| | 1 | 2 | 3 | ····· | n |
|---|---|---|---|---|---|
| 1 | 255 | 160 | 80 | ····· | 235 |
| 2 | 220 | 10 | 123 | ····· | 250 |
| 3 | 3 | 8 | 100 | ····· | 135 |
| 4 | 23 | 200 | 105 | ····· | 254 |
| ⋮ | ⋮ | ⋮ | ⋮ | ⋮ | ⋮ |
| m | 198 | 0 | 16 | ····· | 188 |

Fig.8B

| | 1 | 2 | 3 | ····· | n |
|---|---|---|---|---|---|
| 1 | 7 | 4 | 3 | ····· | 5 |
| 2 | 5 | 1 | 3 | ····· | 6 |
| 3 | 1 | 7 | 3 | ····· | 4 |
| 4 | 2 | 5 | 3 | ····· | 7 |
| ⋮ | ⋮ | ⋮ | ⋮ | ⋮ | ⋮ |
| m | 5 | 0 | 2 | ····· | 4 |

Fig.10

POSTERIOR GRADATION VALUE

PRIOR GRADATION SECTION VALUE

| | 0 | ··· | 32 | ··· | 64 | ··· | 96 | ··· | 128 | ··· | 160 | ··· | 192 | ··· | 224 | ··· | 255 |
|---|---|---|---|---|---|---|---|---|---|---|---|---|---|---|---|---|---|
| 0 | 0 | ··· | 80 | ··· | 108 | ··· | 102 | ··· | 85 | ··· | 65 | ··· | 43 | ··· | 22 | ··· | 0 |
| 1 | 0 | ··· | 40 | ··· | 80 | ··· | 75 | ··· | 50 | ··· | 43 | ··· | 35 | ··· | 20 | ··· | 0 |
| 2 | 0 | ··· | 0 | ··· | 40 | ··· | 35 | ··· | 35 | ··· | 20 | ··· | 20 | ··· | 10 | ··· | 0 |
| 3 | 0 | ··· | -20 | ··· | 0 | ··· | 0 | ··· | 20 | ··· | 10 | ··· | 20 | ··· | 10 | ··· | 0 |
| 4 | 0 | ··· | -27 | ··· | -40 | ··· | -25 | ··· | 0 | ··· | 0 | ··· | 10 | ··· | 5 | ··· | 0 |
| 5 | 0 | ··· | -30 | ··· | -50 | ··· | -60 | ··· | -35 | ··· | -25 | ··· | 0 | ··· | 0 | ··· | 0 |
| 6 | 0 | ··· | -30 | ··· | -50 | ··· | -70 | ··· | -60 | ··· | -40 | ··· | -10 | ··· | 0 | ··· | 0 |
| 7 | 0 | ··· | -32 | ··· | -58 | ··· | -78 | ··· | -72 | ··· | -44 | ··· | -22 | ··· | -5 | ··· | 0 |

Fig.11

POSTERIOR GRADATION VALUE

PRIOR GRADATION VALUE

| | 0 | ··· | 32 | ··· | 64 | ··· | 96 | ··· | 128 | ··· | 160 | ··· | 192 | ··· | 224 | ··· | 255 |
|---|---|---|---|---|---|---|---|---|---|---|---|---|---|---|---|---|---|
| 0 | 0 | ··· | 112 | ··· | 172 | ··· | 198 | ··· | 213 | ··· | 225 | ··· | 235 | ··· | 246 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 32 | 0 | ··· | 32 | ··· | 104 | ··· | 145 | ··· | 176 | ··· | 201 | ··· | 221 | ··· | 240 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 64 | 0 | ··· | 14 | ··· | 64 | ··· | 116 | ··· | 155 | ··· | 189 | ··· | 214 | ··· | 238 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 96 | 0 | ··· | 9 | ··· | 43 | ··· | 96 | ··· | 141 | ··· | 179 | ··· | 209 | ··· | 236 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 128 | 0 | ··· | 6 | ··· | 27 | ··· | 78 | ··· | 128 | ··· | 170 | ··· | 204 | ··· | 234 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 160 | 0 | ··· | 4 | ··· | 20 | ··· | 60 | ··· | 114 | ··· | 160 | ··· | 198 | ··· | 231 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 192 | 0 | ··· | 2 | ··· | 14 | ··· | 44 | ··· | 100 | ··· | 150 | ··· | 192 | ··· | 228 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 224 | 0 | ··· | 0 | ··· | 10 | ··· | 28 | ··· | 79 | ··· | 137 | ··· | 184 | ··· | 224 | ··· | 255 |
| ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ | ⋮ |
| 255 | 0 | ··· | 0 | ··· | 6 | ··· | 18 | ··· | 56 | ··· | 116 | ··· | 170 | ··· | 219 | ··· | 255 |

Fig.12

POSTERIOR GRADATION VALUE

PRIOR GRADATION VALUE

| | 0 | 32 | 64 | 96 | 128 | 160 | 192 | 224 | 255 |
|---|---|---|---|---|---|---|---|---|---|
| 0 | 0 | 88 | 134 | 166 | 186 | 204 | 220 | 238 | 255 |
| 32 | 0 | 32 | 92 | 118 | 151 | 186 | 215 | 238 | 255 |
| 64 | 0 | 24 | 64 | 105 | 148 | 182 | 214 | 236 | 255 |
| 96 | 0 | 24 | 62 | 96 | 138 | 170 | 204 | 234 | 255 |
| 128 | 0 | 24 | 42 | 82 | 128 | 168 | 203 | 233 | 255 |
| 160 | 0 | 24 | 38 | 68 | 116 | 160 | 197 | 230 | 255 |
| 192 | 0 | 16 | 30 | 66 | 108 | 150 | 192 | 228 | 255 |
| 224 | 0 | 8 | 28 | 60 | 102 | 142 | 182 | 224 | 255 |
| 255 | 0 | 0 | 22 | 50 | 89 | 128 | 180 | 220 | 255 |

DISPLAY APPARATUS INCLUDING A DRIVER USING A LOOKUP TABLE

TECHNICAL FIELD

The present invention relates to display devices, and particularly to a liquid crystal display device in which overshoot drive is performed in order to suppress poor moving images from being displayed due to low response speed of liquid crystals.

BACKGROUND ART

In recent years, there has been strong demand for lighter and thinner displays for personal computers, television sets and the like, and therefore liquid crystal display devices, which readily meet such demand for lighter and thinner displays, have been increasingly employed. However, the liquid crystals are slow in response speed, and therefore in the case of displaying moving images on the liquid crystal display device, it might not be possible to obtain satisfactory image quality. Accordingly, a drive system called "overshoot drive" has been conventionally employed in order to suppress moving images from being displayed in low quality due to the low response speed of the liquid crystals. The overshoot drive is a drive system in which a drive voltage higher or lower than a predetermined gradation voltage that corresponds to an image signal for the current frame is supplied to a liquid crystal display panel in accordance with a combination of an image signal for the immediately preceding frame and the image signal for the current frame. By employing the overshoot drive, a time period required for reaching the predetermined gradation voltage that corresponds to the image signal for the current frame is shortened, so that the moving images on the liquid crystal display device are suppressed from being displayed in low quality.

In the liquid crystal display device employing the overshoot drive, a look-up table as described below is held, such that a drive voltage is determined in accordance with a combination of a gradation value that corresponds to the image signal for the immediately preceding frame (hereinafter, referred to as the "prior gradation value") and a gradation value that corresponds to the image signal for the current frame (hereinafter, referred to as the "posterior gradation value"). FIG. 11 is a diagram schematically illustrating the contents of a conventional look-up table held in a liquid crystal display device capable of 256-gradation display. In FIG. 11, numerical values shown in the leftmost column indicate prior gradation values, and numerical values shown in the uppermost row indicate posterior gradation values. Furthermore, numerical values shown at intersections between the rows and columns indicate gradation values (hereinafter, referred to as the "applied gradation values") corresponding to drive voltages, which are determined in accordance with combinations of their respective prior gradation values and posterior gradation values. For example, when the prior gradation value is "64" and the posterior gradation value is "128", the applied gradation value is "155". Note that FIG. 11 shows only nine typical examples of 256 gradation values for each of the prior gradation value and the posterior gradation value.

Incidentally, in the case of the 256-gradation display, there are 65,536 (=256×256) combinations of the prior gradation value and the posterior gradation value. Accordingly, 65,536 applied gradation values have to be stored in the look-up table. In other words, in order to configure the look-up table, a memory capacity capable of storing the 65,536 applied gradation values is required. Also, the number of bits required for representing each of the 256 gradations is eight. Therefore, eight bits are required for each of the 65,536 applied gradation values.

In addition, as described above, in the case of performing the overshoot drive, the applied gradation value is determined in accordance with a combination of the prior gradation value and the posterior gradation value with reference to the look-up table. Accordingly, the prior gradation value has to be held for each pixel in a frame. Therefore, the liquid crystal display device employing the overshoot drive is provided with a memory device, such as a RAM (Random Access Memory), which is called the "frame memory", in order to hold the prior gradation value for each pixel in the frame. For example, in the case of a liquid crystal display device with 480 scanning signal lines and 640 video signal lines, the number of pixels is 307,200 (=480×640). Since the number of bits (bit number) required for representing each of the 256 gradations is eight, eight bits are required for each prior gradation value for the 307,200 pixels.

As such, in order to determine the applied gradation value in accordance with a combination of the prior gradation value and the posterior gradation value, the liquid crystal display device employing the overshoot drive requires the above-described look-up table and frame memory. However, recent years have seen an increase in demand for more compact mobile terminal devices such as cell phones, and in order to realize further compactness, it is necessary to achieve a reduction in required memory capacity.

Therefore, Japanese Laid-Open Patent Publication No. 2004-4629 discloses a liquid crystal display device with reduced memory capacity for the look-up table. FIG. 12 is a diagram schematically illustrating the contents of the look-up table held in the liquid crystal display device. For each of the prior gradation value and the posterior gradation value, only nine of 256 gradation values are stored in the look-up table. As shown in FIG. 12, the applied gradation value is stored in the look-up table in association with each combination of the nine prior gradation values and the nine posterior gradation values. That is, the number of applied gradation-values stored in the look-up table is 81 (=9×9).

In the case, for example, where the prior gradation value is "128", and the posterior gradation value is "192", the applied gradation value is determined as "203" according to the look-up table. On the other hand, in the case, for example, where the prior gradation value is "16", and the posterior gradation value is "80", the applied gradation value cannot be determined directly from the values stored in the look-up table. In such a case, the applied gradation value is determined by interpolation calculation based on applied gradation values obtained in the cases where: the prior gradation value is "0" and the posterior gradation value is "64"; the prior gradation value is "0" and the posterior gradation value is "96"; the prior gradation value is "32" and the posterior gradation value is "64"; and the prior gradation value is "32" and the posterior gradation value is "96". In this manner, by calculating the applied gradation value by interpolation calculation, it becomes possible to reduce the memory capacity required for the look-up table.

In addition, Japanese Laid-Open Patent Publication No. 2004-109796 discloses a liquid crystal display device in which the applied gradation value is determined based on the upper four bits of the prior gradation value corresponding to the image signal for the immediately preceding frame stored in the frame memory and the upper four bits of the posterior gradation value corresponding to the image signal for the current frame. According to this liquid crystal display device, the look-up table holds values, each of which indicates a corresponding one of 16 sections into which the 256 gradation values are classified, instead of holding the prior gradation values and the posterior gradation values. In addition, the number of applied gradation values stored in the look-up table is 256.

[Patent Document 1] Japanese Laid-Open Patent Publication No. 2004-4629

[Patent Document 2] Japanese Laid-Open Patent Publication No. 2004-109796

DISCLOSURE OF THE INVENTION

Problems to be Solved by the Invention

However, in the aforementioned case where the gradation values are classified according to their upper bits, it is not easy to determine the applied gradation value. In addition, even if the overshoot drive is performed based on the applied gradation value determined according to such a look-up table, it is not always suitable for response characteristics of the liquid crystals. Accordingly, while the memory capacity required for the look-up table can be reduced, the reduction in image quality might not always be satisfactorily suppressed.

Therefore, an objective of the present invention is to provide a liquid crystal display device that can be more compact in size while being capable of suppressing moving images from being displayed in low quality.

Means for Solving the Problems

A first aspect of the present invention is directed to a display device including: a display unit for displaying an image with a plurality of gradations; a plurality of video signal lines for displaying the image on the display unit; and an applied gradation value determination unit for determining an applied gradation value to generate a video signal that is to be applied to the video signal lines, the applied gradation value being determined in accordance with an externally inputted first image signal, and a second image signal externally inputted one frame period previous to the first image signal, the one frame period being a period of time in which one screen image is displayed, wherein the device further comprises an applied gradation value determination table having stored therein first input values, second input values, and output values corresponding to combinations of the first input values and the second input values, wherein in the applied gradation value determination table, as the first input values, a plurality of gradation values indicating the plurality of gradations are stored and, as the second input values, a plurality of gradation section values, which indicate a plurality of gradation sections determined by classifying the gradation values in accordance with one or more thresholds, are stored, each gradation section being composed of one or more gradation values, and wherein the applied gradation value determination unit obtains output values corresponding to a combination of the gradation values as the first input values, the first input values being corresponding to the first image signal, and the gradation section values as the second input values, the second input values indicating gradation sections in which gradation values corresponding to the second image signal are included, in accordance with the applied gradation value determination table, and determines the applied gradation values in accordance with the output values.

In a second aspect of the present invention, based on the first aspect of the invention, the plurality of gradation section values, instead of the plurality of gradation values, are stored in the applied gradation value determination table as the first input values, and the applied gradation value determination unit obtains output values corresponding to a combination of the gradation section values as the first input values, the first input values indicating gradation sections in which gradation values corresponding to the first image signal are included, and the gradation section values as the second input values, the second input values indicating gradation sections in which gradation values corresponding to the second image signal are included, in accordance with the applied gradation value determination table, and determines the applied gradation values in accordance with the output values.

In a third aspect of the present invention, based on the first aspect of the invention, a frame data storage unit for storing data corresponding to the one screen image is further included, the frame data storage unit has stored therein gradation section values for the one screen image, and the applied gradation value determination unit, when determining the applied gradation value, obtains a gradation section value as the second input value from the frame data storage unit, and stores to the frame data storage unit a gradation section value indicating a gradation section in which a gradation value corresponding to the first image signal is included.

In a fourth aspect of the present invention, based on the first aspect of the invention, a gradation section setting table having stored therein the plurality of gradation section values and the thresholds is further included, the plurality of gradation values are classified into the plurality of gradation sections in accordance with the gradation section setting table, and the applied gradation value determination unit determines for each gradation value which one of the gradation sections includes the gradation value, in accordance with the gradation section setting table.

In a fifth aspect of the present invention, based on the fourth aspect of the invention, the applied gradation value determination table and the gradation section setting table are stored in a nonvolatile memory.

In a sixth aspect of the present invention, based on the first aspect of the invention, the applied gradation value determination unit calculates the applied gradation value by adding the output value to the gradation value corresponding to the first image signal.

Advantages of the Invention

According to the first aspect of the invention, the applied gradation value determination table has stored therein a plurality of gradation values, a plurality of gradation section values indicating a plurality of gradation sections into which the gradation values are classified in accordance with one or more thresholds, and output values corresponding to combinations of the gradation values and the gradation section values. Therefore, the quantity of data that are to be stored can be significantly reduced compared to conventional applied gradation value determination tables in which the gradation values are not classified into a plurality of gradation sections. Thus, the required memory capacity can be reduced, making it possible to reduce the size of display devices more easily than in the conventional art.

According to the second aspect of the invention, the applied gradation value determination table has stored therein gradation section values that are to be correlated with externally inputted image signals, gradation section values that are to be correlated with an image signal inputted one frame earlier, and output values corresponding to combinations of the two types of gradation section values. Therefore, the quantity of data that is to be stored in the applied gradation value determination table can be reduced more than in the first aspect of the invention. Thus, it is possible to further reduce the size of the display devices.

According to the third aspect of the invention, the frame data storage unit has stored therein gradation section values for one screen image. Therefore, the size of data that is to be stored can be smaller than those in conventional frame data storage units in which gradation values for one screen image are stored. Thus, the required memory capacity can be reduced, making it possible to reduce the size of the display devices.

According to the fourth aspect of the invention, the gradation section setting table is provided in order to classify the gradation values into a plurality of gradation sections. Therefore, it is possible to readily set and change the gradation values included in each gradation section.

According to the fifth aspect of the invention, the applied gradation value determination table and the gradation section setting table are stored in a nonvolatile memory. Therefore, even when the display device is turned off, the contents of the applied gradation value determination table and the gradation section setting table are maintained. Thus, it is possible to eliminate the need to write data to the tables each time the display device is activated.

According to the sixth aspect of the invention, the applied gradation value is calculated by adding an output value obtained from the applied gradation value determination table to a gradation value corresponding to an externally inputted image signal. Therefore, it is possible to suppress moving images from being displayed in low quality due to low response speed of liquid crystals. Thus, it is possible to reduce the size of the display devices while suppressing image quality deterioration.

BRIEF DESCRIPTION OF THE DRAWINGS

FIG. 3 is a diagram for explaining the differences between posterior gradation values and applied gradation values in the conventional art.

FIG. 4 is a diagram for explaining differential gradation values.

FIG. 6 is a diagram illustrating a look-up table in the embodiment.

FIG. 7 is a diagram illustrating a threshold table in the embodiment.

FIG. 8 A is a schematic representation of the contents of a conventional frame memory. B is a schematic representation of the contents of a frame memory in the embodiment.

FIG. 10 is a diagram illustrating a look-up table in a variant of the embodiment.

FIG. 11 is a diagram illustrating an exemplary conventional look-up table.

FIG. 12 is a diagram illustrating another exemplary conventional look-up table.

LEGEND

Figure 1:
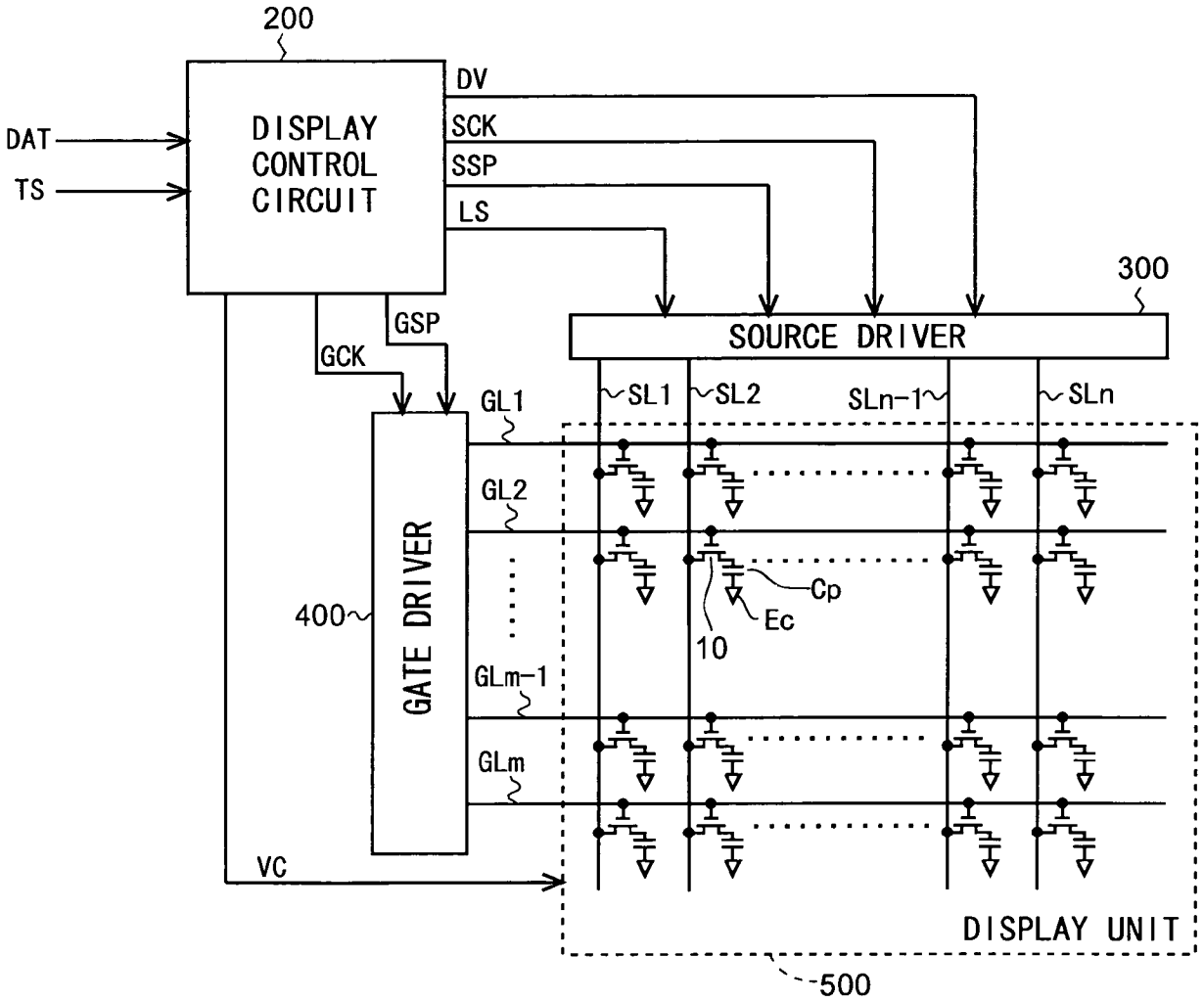
FIG. 1 is a block diagram illustrating the overall configuration of an active matrix-type liquid crystal display device according to one embodiment of the present invention.

2 look-up table
3 threshold table
20 nonvolatile memory
21 frame memory
22 control circuit
23 display data calculation circuit
200 display control circuit
300 source driver
400 gate driver
500 display unit

BEST MODE FOR CARRYING OUT THE INVENTION

Hereinafter, an embodiment of the present invention will be described with reference to the accompanying drawings.

<1. Overall Configuration and Operation of the Liquid Crystal Display Device>

FIG. 1 is a block diagram illustrating the overall configuration of an active matrix-type liquid crystal display device according to a first embodiment of the present invention. The liquid crystal display device includes a display control circuit 200, a source driver (video signal line drive circuit) 300, a gate driver (scanning signal line drive circuit) 400, and a display unit 500. The display unit 500 includes a plurality (n) of video signal lines SL1-SLn, a plurality (m) of scanning signal lines GL1-GLm, and a plurality (n×m) of pixel forming portions provided at their corresponding intersections between the video signal lines SL1-SLn and the scanning signal lines GL1-GLm. Each pixel forming portion is composed of: a TFT 10, which is a switching element having a gate terminal connected to the scanning signal line passing through the corresponding intersection and a source terminal connected to the video signal line passing through the same intersection; a pixel electrode connected to a drain terminal of the TFT 10; and a liquid crystal layer commonly provided in the pixel forming portions and disposed between the pixel electrode and a common electrode Ec. In addition, a capacitance formed by the pixel electrode and the common electrode Ec constitutes a pixel capacitance Cp. Furthermore, each pixel forming portion corresponds to one pixel in a displayed image, and a gradation level is determined for each pixel. In the present embodiment, it is assumed that 256-gradation display is provided. Note that a gradation value determined for each pixel is also referred to below as the "pixel gradation value".

The display control circuit 200 receives image data DAT and a timing control signal TS, which are externally transmitted, and outputs a digital video signal DV, while outputting a source start pulse signal SSP, a source clock signal SCK, a latch strobe signal LS, a gate start pulse signal GSP, and a gate clock signal GCK, which are for controlling the timing of displaying an image on the display unit 500, and a common electrode drive signal VC for driving the common electrode Ec.

The source driver 300 receives the digital video signal DV, the source start pulse signal SSP, the source clock signal SCK, and the latch strobe signal LS, which are outputted from the display control circuit 200, and applies a drive video signal to each of the video signal lines SL1-SLn in order to charge the pixel capacitance of each pixel forming portion in the display unit 500. In this case, the source driver 300 sequentially holds the digital video signal DV representing a voltage to be applied to each of the video signal lines SL1-SLn, in accordance with the timing of generating pulses of the source clock signal SCK. Thereafter, the digital video signal DV being held is converted into an analog voltage in accordance with the timing of generating pulses of the latch strobe signal LS, and the resultant voltage is simultaneously applied to all the video signal lines SL1-SLn as the drive video signal. In order to sequentially select each of the scanning signal lines GL1-GLm for one horizontal scanning period, the gate driver 400 repeatedly applies an active scanning signal to each scanning signal line in cycles of one vertical scanning period in accordance with the gate start pulse signal GSP and the gate clock signal GCK, which are outputted from the display control circuit 200. In this manner, the drive video signal is applied to each of the video signal lines SL1-SLn, and the scanning signal is applied to each of the scanning signal lines GL1-GLm, so that the image is displayed on the display unit 500.

<2. Configuration and Operation of the Display Control Circuit>

Figure 2:
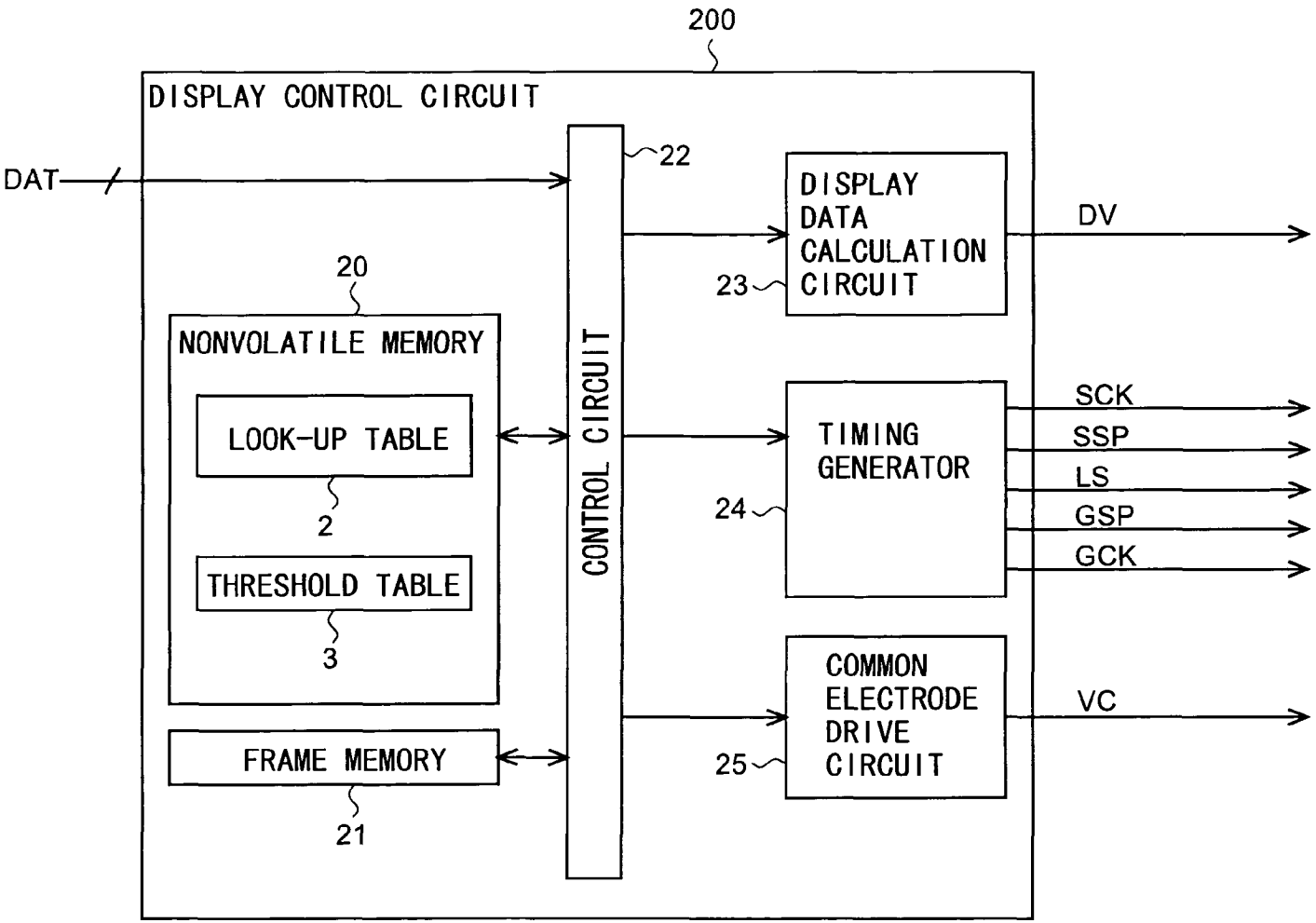
FIG. 2 is a block diagram illustrating in detail the configuration of a display control circuit in the embodiment.

FIG. 2 is a block diagram illustrating the configuration of the display control circuit 200 in the present embodiment. The display control circuit 200 includes: a nonvolatile memory 20; a frame memory 21 as a frame data storage unit; a control circuit 22; a display data calculation circuit 23; a timing generator 24; and a common electrode drive circuit 25.

The nonvolatile memory 20 holds a look-up table 2 as a table for determining the applied gradation value, and a threshold table 3 as a table for setting the gradation sections. The look-up table 2 is a table for determining a drive voltage for performing the overshoot drive in accordance with externally transmitted image data DAT for the current frame and image data DAT for the frame immediately preceding the current frame. The threshold table 3 is a table for storing gradation value thresholds to classify 256 gradation values. Note that the look-up table 2 and the threshold table 3 will be described in detail later. The frame memory 21 holds gradation section values to be described later, which are each determined in accordance with a pixel gradation value, in relation to image data DAT for one frame.

The control circuit 22 receives the externally transmitted image data DAT, and controls operations of the display data calculation circuit 23, the timing generator 24 and the common electrode drive circuit 25, such that an image based on the image data DAT is displayed on the display unit 500. At this time, the control circuit 22 refers to the look-up table 2 and the threshold table 3 stored in the nonvolatile memory 20, and controls the operation of the display data calculation circuit 23 in accordance with the image data DAT, and data stored in the frame memory 21 regarding the immediately preceding frame. The display data calculation circuit 23 calculates an applied gradation value for generating a drive voltage for performing the overshoot drive, and outputs the applied gradation value as the digital video signal DV. The timing generator 24 outputs the source start pulse signal SSP, the source clock signal SCK and the latch strobe signal LS in order to control the operation of the source driver 300, while outputting the gate start pulse signal GSP and the gate clock signal GCK in order to control the operation of the gate driver 400. The common electrode drive circuit 25 outputs the common electrode drive signal VC in order to drive the common electrode Ec. Note that an applied gradation value determination unit is implemented by the control circuit 22 and the display data calculation circuit 23.

<3. Look-Up Table>

Referring to FIGS. 3 to 6 and FIG. 11, the look-up table 2 in the present embodiment will be described next. FIG. 3 is a diagram for explaining the difference between the posterior gradation value and the applied gradation value in the conventional art (hereinafter, referred to as the "differential gradation value"). Note that FIG. 3 is configured based on the look-up table 2 shown in FIG. 11. Here, the differential gradation value refers to a gradation value added to the posterior gradation value, which is an originally targeted gradation value, in order to shorten the time period until the voltage corresponding to the posterior gradation value is applied to the liquid crystals. An example will be given, where the prior gradation value is "32" and the posterior gradation value is "128". In this case, as shown in FIG. 11, the applied gradation value is "176". At this time, the value obtained by subtracting the posterior gradation value from the applied gradation value is "48". Accordingly, in the case where the prior gradation value is "32" and the posterior gradation value is "128", the differential gradation value is "48" Also, in the case where the prior gradation value is "160" and the posterior gradation value is "64", the applied gradation value is "20" as shown in FIG. 11, and therefore the differential gradation value is "−44". Referring to FIG. 3 thus configured, a discussion will be held on the tendency of the differential gradation value determined based on the prior gradation value and the posterior gradation value. As shown in FIG. 3, the differential gradation values corresponding to their respective posterior gradation values in the case of the prior gradation value "64" are relatively close to their counterpart differential gradation values corresponding to their respective posterior gradation values in the case of the prior gradation value "96". Similarly, differential gradation values corresponding to their respective posterior gradation values in the case of the prior gradation value "128" are relatively close to their counter part differential gradation values corresponding to their respective posterior gradation values in the case of the prior gradation value "160". Also, differential gradation values corresponding to their respective posterior gradation values in the case of the prior gradation value "192" are relatively close to their counterpart differential gradation values corresponding their respective posterior gradation values in the case of the prior gradation value "224". In consideration of the foregoing, it is conceivable that even when the applied gradation value is determined based on the differential gradation value shown in, for example, FIG. 4, for each combination of the prior gradation value and the posterior gradation value, substantially the same effect can be achieved as in the case where the applied gradation value is determined according to the conventional look-up table 2 shown in FIG. 11.

Figure 5:
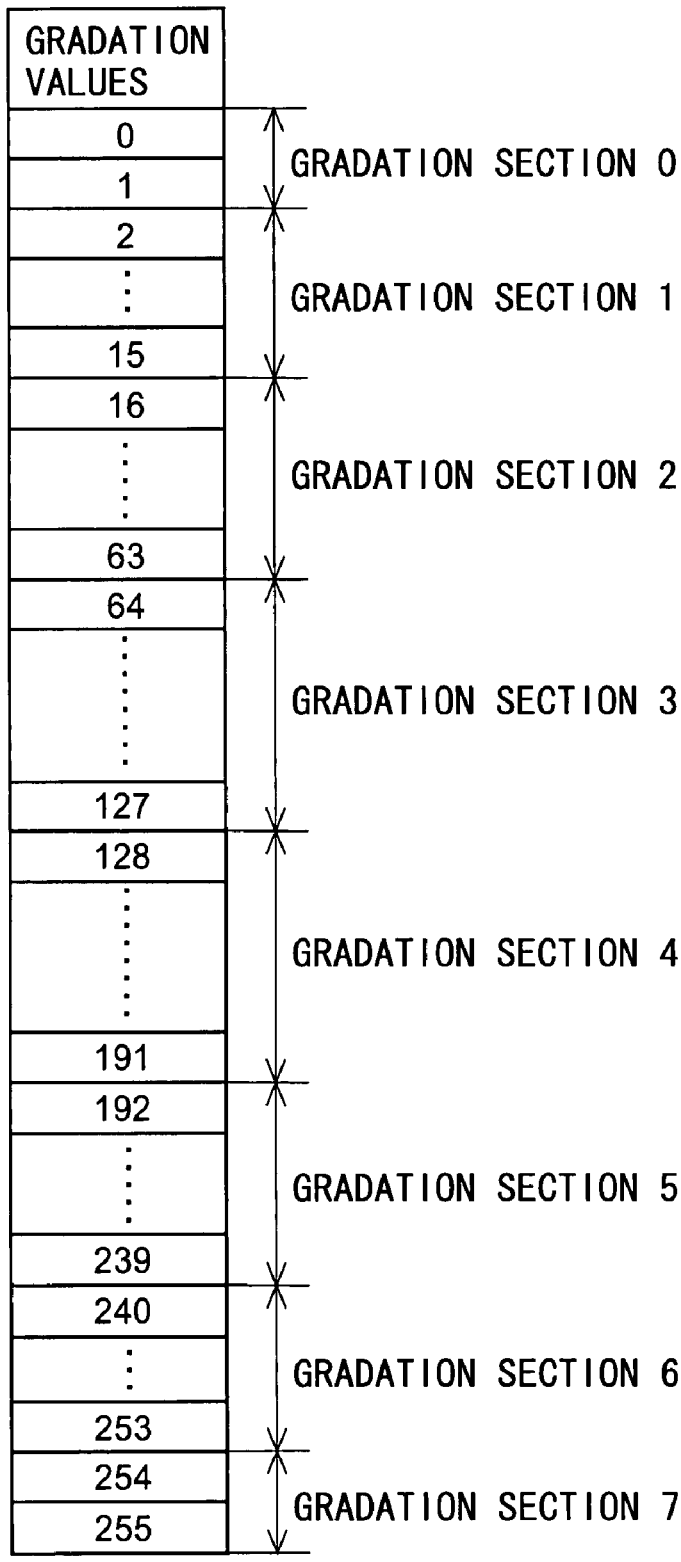
FIG. 5 is a diagram for explaining the gradation section values.

Therefore, in the present embodiment, gradation values that are similar to each other in terms of the tendencies of their respective differential gradation values are grouped, such that the differential gradation values are each determined in accordance with combinations of the group to which their respective prior gradation values belong and the group to which their respective posterior gradation values belong. Note that the groups of gradation values are referred to as the "gradation sections", and the gradation sections are specified as the "gradation section 0", "gradation section 1", "gradation section 2", etc. FIG. 5 is a diagram for explaining the gradation sections. In the present embodiment, 256 gradation values are grouped (classified) into eight gradation sections. The grouping is performed such that prior gradation values that are similar to each other in terms of the tendencies of their respective differential gradation values are included in the same gradation section. For example, the gradation values from "64" to "127" are included in the "gradation section 3". In accordance with the gradation sections thus determined, the look-up table 2 in the present embodiment is generated as shown in FIG. 6. While the conventional look-up table 2 shown in FIG. 11 has stored therein the applied gradation values corresponding to the combinations of the prior gradation value and the posterior gradation value, the look-up table 2 in the present embodiment shown in FIG. 6 has stored therein differential gradation values as output values corresponding to combinations of the gradation section including their respective prior gradation values (hereinafter, referred to as the "prior gradation section") and the gradation section including their respective posterior gradation values (hereinafter, referred to as the "posterior gradation section"). Note that a value indicating the gradation section is referred to as the "gradation section value" (e.g., the gradation section value for the gradation section 3 is "3").

As described above, the look-up table 2 in the present embodiment has stored therein the differential gradation values corresponding to combinations of values for the prior gradation sections (prior gradation section values) and values for the posterior gradation sections (posterior gradation section values). Accordingly, the gradation section value has to be acquired in accordance with a gradation value indicated by externally transmitted image data DAT. Therefore, in the present embodiment, a table (threshold table) as shown in FIG. 7 is held in which the gradation section values are correlated with the maximum from among their corresponding gradation values. This enables acquisition of a gradation section value for a pixel in accordance with the gradation value of the pixel. For example, when the gradation value of the pixel is "100", the gradation section value for the pixel is "3". Note that as described above, the threshold table 3 is stored in the nonvolatile memory 20 within the display control circuit 200 shown in FIG. 2.

<4. Frame Memory>

Referring to FIG. 8, the frame memory 21 in the present embodiment will be described next. FIG. 8 is a diagram schematically illustrating data stored in the frame memory 21. Data stored in the conventional frame memory 21 is shown in FIG. 8A, while data stored in the frame memory 21 in the present embodiment is shown in FIG. 8B. In FIGS. 8A and 8B, numerical values shown in the leftmost column denote rows of the scanning signal lines (e.g., the scanning signal line in the first row is denoted by "1", the scanning signal line in the second row is denoted by "2", . . . , and the scanning signal line in the m'th row is denoted by "m") while numerical values shown in the uppermost row denote columns of the video signal lines (the video signal line in the first column is denoted by "1", the video signal line in the second column is denoted by "2", . . . , and the video signal line in the n'th column is denoted by "n"). In addition, numerical values shown at intersections between the rows and columns indicate data for their corresponding pixels.

The conventional frame memory 21 has stored therein the gradation values as data concerning pixels. Specifically, the conventional frame memory 21 has stored therein any value from "0" to "255" for each of (m×n) pixels. On the other hand, in the present embodiment, the differential gradation value is determined in accordance with a combination of the prior gradation section value and the posterior gradation section value, and therefore the prior gradation section value has to be held for each pixel. Accordingly, in the present embodiment, the prior gradation section value for each pixel is stored in the frame memory 21. Therefore, as shown in FIG. 8B, the frame memory 21 in the present embodiment has stored therein any value from "0" to "7" for each of (m×n) pixels.

<5. Drive Method>

Figure 9:
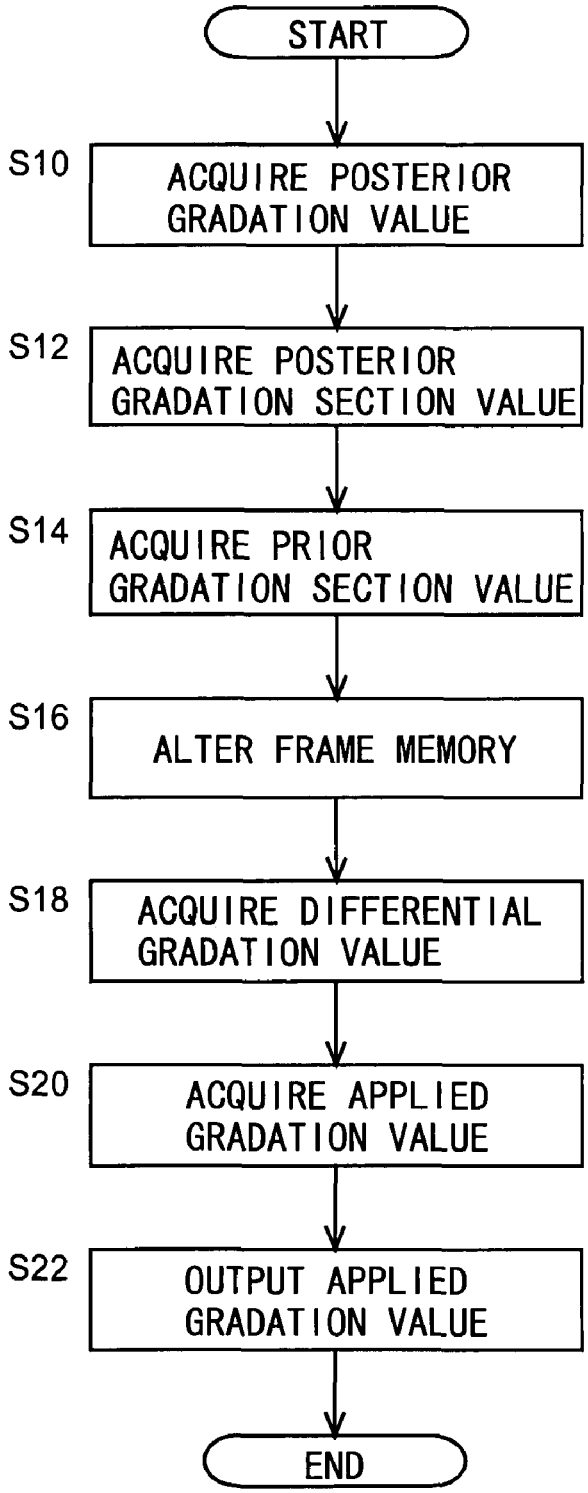
FIG. 9 is a flowchart illustrating the procedure in the embodiment, from receiving of image data to outputting of a digital video signal.

Referring to FIG. 9, the procedure of a process performed in the display control circuit 200 for outputting a digital video signal DV in accordance with externally inputted image data DAT will be described next. FIG. 9 is a flowchart illustrating the procedure in the display control circuit 200, from inputting of image data DAT for a pixel to outputting of a digital video signal DV based on the image data DAT. Note that a pixel targeted for processing is referred to as the "target pixel".

First, the control circuit 22 receives externally inputted image data DAT (step S10). The image data DAT indicates a gradation value (posterior gradation value) for the target pixel in the current frame. That is, the image data DAT has a value from "0" to "255". After the acquisition of the image data DAT, a gradation section value (posterior gradation section value) for the target pixel in the current frame is obtained in accordance with the image data DAT and the threshold table 3 stored in the nonvolatile memory 20 (step S12). For example, in the case where the threshold table 3 as shown in FIG. 7 is stored in the nonvolatile memory 20, when the gradation value indicated by the image data DAT is "50", the posterior gradation section value is "2".

After the posterior gradation section value is obtained, the gradation section value (prior gradation section value) for the target pixel in the last frame is obtained from the frame memory 21 (step S14). Thereafter, the posterior gradation section value for the target pixel is written into the frame memory 21 (step S16). Specifically, as a result of steps S14 and S16, data for the target pixel stored in the frame memory 21 is altered from the prior gradation section value to the posterior gradation section value.

After step S16 is completed, the procedure advances to step S18, where a differential gradation value is obtained in accordance with a combination of the posterior gradation section value obtained at step S12 and the prior gradation section value obtained at step S14, with reference to the look-up table 2 stored in the nonvolatile memory 20. Thereafter, an applied gradation value is calculated in accordance with the differential gradation value (step S20). Specifically, the display data calculation circuit 23 calculates the applied gradation value by adding the differential gradation value to the posterior gradation value. Thereafter, the display data calculation circuit 23 outputs a digital video signal DV in accordance with the applied gradation value (step S22).

<6. Effects>

As described above, according to the present embodiment, the look-up table 2 has stored therein the differential gradation values corresponding to combinations of their respective prior gradation section values and posterior gradation section values. The prior gradation section values and the posterior gradation section values indicate gradation sections into which gradation values are grouped in accordance with predetermined thresholds. On the other hand, the conventional look-up table 2 has stored therein the applied gradation values corresponding to combinations of their respective prior gradation values and posterior gradation values. Accordingly, the quantity of data that is to be stored in the look-up table 2 for the purpose of overshoot drive can be reduced compared to the quantity stored conventionally. Therefore, it is possible to reduce the capacity of the nonvolatile memory 20 for storing the look-up table 2 compared to the capacity required conventionally.

In addition, according to the present embodiment, the frame memory 21 has stored therein the prior gradation section value for each pixel. On the other hand, the conventional frame memory 21 has stored therein the prior gradation value for each pixel. As described above, the gradation sections are groups into which the gradation values are classified, and therefore the number of bits in data required for representing the gradation section value is smaller than the number of bits in data required for representing the gradation value. Thus, the capacity of the frame memory 21 required for the overshoot drive can be reduced compared to the capacity required conventionally.

The reduction of the memory capacity will be concretely described below. Consider now an exemplary liquid crystal display device for 256-gradation display, in which the number of scanning signal lines is 480, and the number of video signal lines is 640. Since this liquid crystal display device provides 256 gradations, there are 65,536 (=256×256) combinations of the prior gradation values and the posterior gradation values. Accordingly, 65,536 applied gradation values are stored in the conventional look-up table 2. On the other hand, in the case where 256 gradations are grouped into eight gradation sections as in the present embodiment, only 64 (8×8) differential gradation values are stored in the look-up table 2. As such, the quantity of data stored in the look-up table 2 can be significantly reduced compared to the quantity stored conventionally.

In addition, since the number of scanning signal lines is 480, and the number of video signal lines is 640, the number of pixels in the liquid crystal display device is 307,200 (=480×640). The prior gradation value is stored in the conventional frame memory 21 for each pixel, and therefore the number of bits in data required for representing each of the 256 gradations is eight. Accordingly, in order to store the prior gradation values for 307,200 pixels, memory for 2,457,600 (307,200×8) bits is required. On the other hand, the prior gradation section value is stored in the frame memory 21 in the present embodiment for each pixel, but the number of bits in data required for representing each of the eight gradation section values is three. Accordingly, in order to store the prior gradation section values for 307,200 pixels, memory for only 921,600 (307,200×3) bits is required. As such, the capacity of the frame memory 21 required for the overshoot drive can be reduced compared to the capacity required conventionally.

In this manner, according to the present embodiment, the quantity of data stored in the look-up table 2 and the amount of data stored in the frame memory 21 are reduced compared to those required conventionally. Accordingly, the memory capacity required by the liquid crystal display device for the overshoot drive can be significantly reduced compared to that required conventionally. In addition, the reduction of the memory capacity enables more compact devices than conventional devices. Furthermore, it is possible to perform overshoot drive to achieve effects substantially the same as those achieved conventionally. Thus, it is possible to realize compact portable terminal devices capable of suppressing moving images from being displayed in low quality.

<7. Variant, Etc.>

Next, a variant of the above embodiment will be described. FIG. 10 is a diagram schematically illustrating the contents of a look-up table 2 in a variant of the above embodiment. According to this variant, the differential gradation value is obtained in accordance with a combination of the prior gradation section value and the posterior gradation value. Therefore, as compared to the above embodiment, the effect of reducing the memory capacity required for the look-up table 2 is reduced, but it is possible to finely set the differential gradation values, making it possible to perform overshoot drive that is more suitably adapted to response characteristics of the liquid crystals. In addition, it is possible to eliminate the need to obtain the posterior gradation section value in accordance with the posterior gradation value.

Also, in the above embodiment, the nonvolatile memory 20 and the frame memory 21 are provided in the display control circuit 200, but the present invention is not limited to this, and the nonvolatile memory 20 and the frame memory 21 may be provided in the source driver 300. In such a case, the display data calculation circuit 23 is also provided in the source driver 300, and a signal indicating the gradation value for each pixel in the current frame is sent from the display control circuit 200 to the source driver 300. Thereafter, the applied gradation value is calculated in the source driver 300, and a drive video signal is outputted to each of the video signal lines SL1-SLn in accordance with the applied gradation value.

Furthermore, in the above embodiment, the gradation values are classified into eight gradation sections, but the present invention is not limited to this. Any number of gradation sections may be used so long as the gradation values in each gradation section are similar to each other in terms of their tendencies regarding the differential gradation value.

The invention claimed is:

1. A display device comprising:

a display unit to display an image with a plurality of gradations;

a plurality of video signal lines to display the image on the display unit;

an applied gradation value determination unit to determine an applied gradation value to generate a video signal that is to be applied to the video signal lines, the applied gradation value being determined in accordance with an externally inputted first image signal, and a second image signal externally inputted one frame period previous to the first image signal, the one frame period being a period of time in which one screen image is displayed;

an applied gradation value determination table to store first input values, second input values, and output values corresponding to combinations of the first input values and the second input values; and a gradation section setting table to store a plurality of gradation section values and a plurality of thresholds corresponding to the plurality of gradation section values, wherein a plurality of gradation values indicating the plurality of gradations are stored as the first input values, and the plurality of gradation section values, which indicate a plurality of gradation sections determined by classifying the gradation values based on the one or more thresholds are stored as the second input values, each gradation section including one or more gradation values, the plurality of gradation values are classified into the plurality of gradation sections based on the gradation section setting table, and the applied gradation value determination unit, determines which one of the gradation sections includes the gradation value for each gradation value based on the gradation section setting table, obtains output values corresponding to a combination of the gradation values as the first input values and the gradation section values as the second input values in accordance with the applied gradation value determination table, the first input values corresponding to the first image signal, the second input values indicating gradation sections in which gradation values corresponding to the second image signal are included, and determines the applied gradation values in accordance with the output values;

wherein overshoot differential gradation values corresponding to the gradation values within each gradation section are similar.

2. The display device according to claim 1, wherein the plurality of gradation section values, instead of the plurality of gradation values, are stored in the applied gradation value determination table as the first input values, the applied gradation value determination unit obtains output values corresponding to a combination of the gradation section values as the first input values, the first input values indicating gradation sections in which gradation values corresponding to the first image signal are included, the applied gradation value determination unit obtains the gradation section values as the second input values, the second input values indicating gradation sections in which gradation values corresponding to the second image signal are included, based on the applied gradation value determination table, and the applied gradation value determination unit determines the applied gradation values based on the output values.

3. The display device according to claim 1, further comprising:

a frame data storage unit to store data corresponding to the one screen image, the stored data being gradation section values associated with the one screen image, wherein the applied gradation value determination unit, when determining the applied gradation value, obtains a gradation section value as the second input value from the frame data storage unit, and the frame data storage unit stores a gradation section value indicating a gradation section in which a gradation value corresponding to the first image signal is included.

4. The display device according to claim 1, wherein the applied gradation value determination table and the gradation section setting table are stored in a nonvolatile memory.

5. The display device according to claim 1, wherein the applied gradation value determination unit calculates the applied gradation value by adding the output value to the gradation value corresponding to the first image signal.

6. The display device according to claim 1, wherein at least two of the gradation sections include a different number of the gradation values.

* * * * *

UNITED STATES PATENT AND TRADEMARK OFFICE

CERTIFICATE OF CORRECTION

PATENT NO. : 8,102,342 B2
APPLICATION NO. : 11/883714
DATED : January 24, 2012
INVENTOR(S) : Hiroaki Shigeta et al.

It is certified that error appears in the above-identified patent and that said Letters Patent is hereby corrected as shown below:

Title page, item (86) PCT No.: should read as follows: PCT/JP2006/304250

Signed and Sealed this
Tenth Day of April, 2012

David J. Kappos

David J. Kappos
*Director of the United States Patent and Trademark Office*